United States Patent [19]

Gogniat

[11] Patent Number: 4,474,482

[45] Date of Patent: Oct. 2, 1984

[54] WATCHCASE

[75] Inventor: Paul Gogniat, Bienne, Switzerland

[73] Assignee: Montres Rado S.A., Longeau, Switzerland

[21] Appl. No.: 379,515

[22] Filed: May 18, 1982

[30] Foreign Application Priority Data

May 22, 1981 [CH] Switzerland ..... 3354/81

[51] Int. Cl.[3] ..... G04B 37/00

[52] U.S. Cl. ..... 368/294; 368/295; 368/296

[58] Field of Search ..... 368/291–296, 368/276, 286; 29/177, 179

[56] References Cited

U.S. PATENT DOCUMENTS

| | | | |
|---|---|---|---|
| 2,597,935 | 5/1952 | Kiehl | 368/294 |
| 4,327,429 | 4/1982 | Klingenberg | 368/294 |

FOREIGN PATENT DOCUMENTS

| | | | |
|---|---|---|---|
| 56-96267 | 8/1981 | Japan | 368/296 |
| 313607 | 6/1956 | Switzerland | 368/296 |
| 321187 | 4/1957 | Switzerland | 368/291 |
| 571244 | 12/1975 | Switzerland | 368/291 |
| 582909 | 12/1976 | Switzerland | 368/291 |

*Primary Examiner*—Bernard Roskoski
*Attorney, Agent, or Firm*—Peter L. Berger

[57] ABSTRACT

A watchcase essentially comprises a crystal 1 engaged in a recess 2 of a bezel or body 3. A material 6 capable of assuming a liquid or pasty consistency at the time of assembly, then solidifying and adhering to the wall 4 of the recess 2 is inserted in the space formed by the walls 4 and 5 of part 3 and crystal 1. The crystal 1 has a configuration such that the material 6, after setting, will exert a geometrical locking effect upon it.

9 Claims, 3 Drawing Figures

WATCHCASE

BACKGROUND AND SUMMARY OF THE INVENTION

The present invention relates to watchcases, and more specifically to the means of attaching a crystal engaged in a recess formed at the top of a constituent part of the case, such as the body or bezel.

In conventional designs, the crystal is commonly contained in its recess by means of a sealing strip in which it is press-fitted, the seal in turn being seated in the recess. The retention of the crystal is effected by forces due to seal-crystal and seal-bezel or -body friction, and the retention will materially depend on the depth of the recess. But this approach cannot be advantageously employed in watchcases of very small thickness.

To overcome this disadvantage, it has also been proposed that the crystal be fixed in its recess by bonding with an adhesive substance formed of synthetic resins. It is known, however, that the cements ordinarily used have several disadvantages, one of which is that their absorption of the differential thermal expansion that may occur in the material of the crystal and the body or bezel is very poor. Besides, if the adhesion is to be good both on the metal of the body or bezel and on the glass, the bonding surfaces must still be comparatively large.

Accordingly, one object of the invention is to propose a means of fixing the crystal in its recess, permitting a marked reduction of the depth of the recess without endangering the strength of the assembly, be easy in execution and substantially impervious to thermal stress or other aging phenomena to which cements are generally susceptible.

To that end, the invention proposes to achieve a sealing of the crystal into its recess by means of a mass of metallic material arranged in the space bounded by the side walls of the recess and the crystal, the said mass adhering by soldering to the wall of the recess on the one hand and on the other hand exerting a geometrical locking effect on the side wall, specially contoured for the purpose of the crystal.

To facilitate introduction of the metallic mass, the latter may comprise a material capable of exhibiting a liquid or pasty consistency at the time of installation of the crystal and then setting under the ordinary conditions of use of the watch.

BRIEF DESCRIPTION OF THE DRAWING

The invention may be understood from a reading of the following description, given with reference to the accompanying drawings, in which.

DETAILED DESCRIPTION

Figure 1:
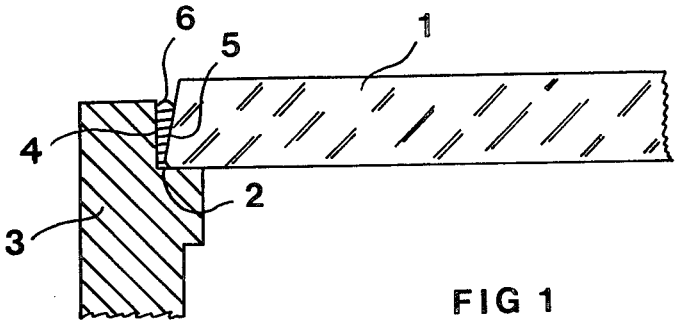
FIG. 1 is a view in partial section of a watch case according to one embodiment of the invention.

The watchcase of FIG. 1 comprise essentially a crystal 1 engaged in a recess 2 formed at the top of a part 3 which may be the body of the case or a bezel. A mass of metallic material 6 is placed in the space bounded by the side walls 4 or part 3 and 5 of crystal 1.

As indicated above, this metallic material must be able on the one hand to assume a pasty or liquid consistency at the time of installation of the crystal and on the other hand to solidify under normal conditions of service of the case, soldering itself to the side wall 4 of the bezel or body 3.

Accordingly, the metallic material used will preferably be a low-melting-point soldering material or a metal amalgam soldifying at room temperature like those used for example in the art of dentistry.

By low melting point is meant a temperature compatible with the heat tolerance of the crystal and the part 3 of the watchcase, for example below 800° C. Preferably, therefore, a corrosion-resistant soldering material will be used whose melting point is close to 620° C., for example such as one based on tin whose melting point is on the order of 180° to 250° C.

When the mass 6 has solidified, it exerts a geometrical locking effect on the side walls of the crystal 1 which is achieved in the embodiment shown by providing said wall with an inclination such that the section of the crystal widens towards the bottom of the recess 2. To improve the tightness of the assembly, the side wall may be previously coated with a metalizing layer, such as copper or gold, ensuring a perfect bond with the material 6.

Figure 2:
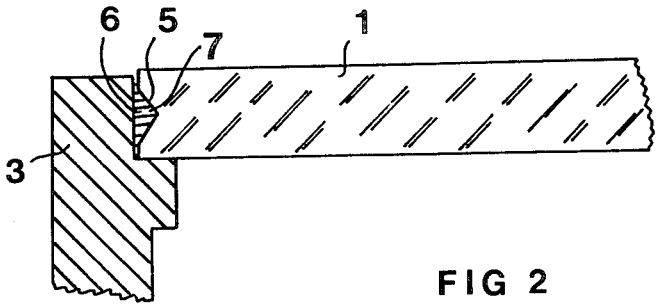
FIGS. 2 and 3 are similar views to that of FIG. 1, showing two other embodiments.
Figure 3:
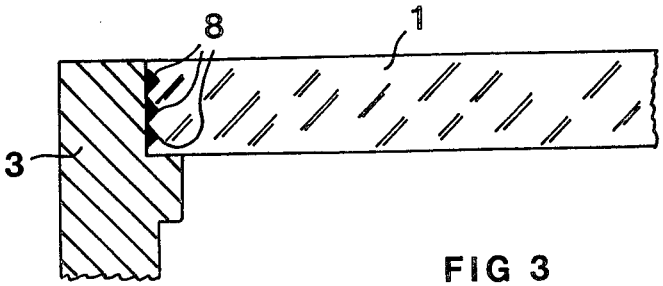

FIGS. 2 and 3 show alternative embodiments of watchcases in which the locking effect is achieved by means of a peripheral groove 7 formed in the side wall 3 or several parallel grooves 8 formed in the side wall 3.

Although it has been described in terms of a particular embodiment, the present invention is by no means limited thereto. On the contrary, it is capable of numerous modifications and variants that will suggest themselves to one skilled in the art.

What is claimed is:

1. A watchcase comprising a crystal engaged in a recess formed at the top of a bezel or body, an improvement comprising contouring the side wall of said crystal in relation to the side wall of said recess to form a locking space therebetween, inserting a suitable material initially exhibiting a liquid consistency in said space, said material setting and bonding to the side wall of the recess, said material bonding to the crystal, the strength of the bond between the crystal and material being lower than the strength of the bond between the side wall of the recess and the material, said side wall of the crystal comprising a widening toward the bottom of the recess to retain the crystal in the recess by the material setting to form a geometrical lock and locking the crystal in place if the bond breaks between the crystal and the material.

2. A watchcase according to claim 1, wherein the metallic material comprises a low melting-point soldering material.

3. A watchcase according to claim 2, wherein the soldering material comprises a silver alloy.

4. A watchcase according to claim 2, wherein the soldering material comprises a tin alloy.

5. A watchcase according to claim 1, wherein the metallic material comprises an amalgam solidifying at room temperature.

6. A watchcase according to claims 1-5, wherein the side wall of the crystal comprises an inclined portion having a profile which enlarges toward the bottom of the recess.

7. A watchcase according to claims 1-5, wherein the side wall of the crystal comprises at least one peripheral groove.

8. A watchcase according to claim 7, wherein the side wall of the crystal has a plurality of parallel peripheral grooves.

9. A watchcase according to claims 1-5, wherein the side wall of the crystal is coated with a metalizing layer.

* * * * *